United States Patent [19]

Hupkes

[11] 4,076,127

[45] Feb. 28, 1978

[54] DEVICE FOR THE PURPOSE OF PREVENTING A BODY DEPENDING FROM ROPES FROM SWINGING

[75] Inventor: Leonard Hupkes, Heemstede, Netherlands

[73] Assignee: Conrad-Stork B.V., Haarlem, Netherlands

[21] Appl. No.: 748,914

[22] Filed: Dec. 9, 1976

[30] Foreign Application Priority Data

Dec. 11, 1975 Netherlands ..... 7514471

[51] Int. Cl.[2] ..... B66C 17/00

[52] U.S. Cl. ..... 212/10; 214/15 R

[58] Field of Search ..... 212/3, 10, 11, 18, 13, 212/14, 40, 83, 97, 124, 125, 8 A, 3; 254/150 R, 144, 188; 214/14, 15 R, 15 C, 13

[56] References Cited

U.S. PATENT DOCUMENTS

| | | | |
|---|---|---|---|
| 459,304 | 9/1891 | O'Reilly | 212/11 |
| 1,408,463 | 3/1922 | Miles | 254/150 R |
| 1,437,685 | 12/1922 | Scharpenberg et al. | 254/188 |
| 1,481,234 | 1/1924 | Smith | 214/14 X |
| 2,799,403 | 7/1957 | Friedman | 212/83 |
| 3,945,508 | 3/1976 | Colin | 214/13 |
| 3,971,478 | 7/1976 | Matasa | 212/11 |

FOREIGN PATENT DOCUMENTS

| | | | |
|---|---|---|---|
| 1,040,415 | 10/1958 | Germany | 254/141 |
| 2,517,332 | 11/1975 | Germany | 214/14 |

*Primary Examiner*—Evon C. Blunk
*Assistant Examiner*—Donald W. Underwood
*Attorney, Agent, or Firm*—Haseltine, Lake & Waters

[57] ABSTRACT

A device for raising and lowering a load while preventing swinging of the load comprising a container bridge having a displaceable trolley thereon, the trolley carrying a drum for hoisting cables which pass over sheaves to the load for raising and lowering the load by wind-up and pay-out of the cables. In order to prevent swinging of the load, a positioning wire extends from a drum on the trolley to the load at an oblique inclination which forms an angle with respect to the hoisting cables.

6 Claims, 1 Drawing Figure

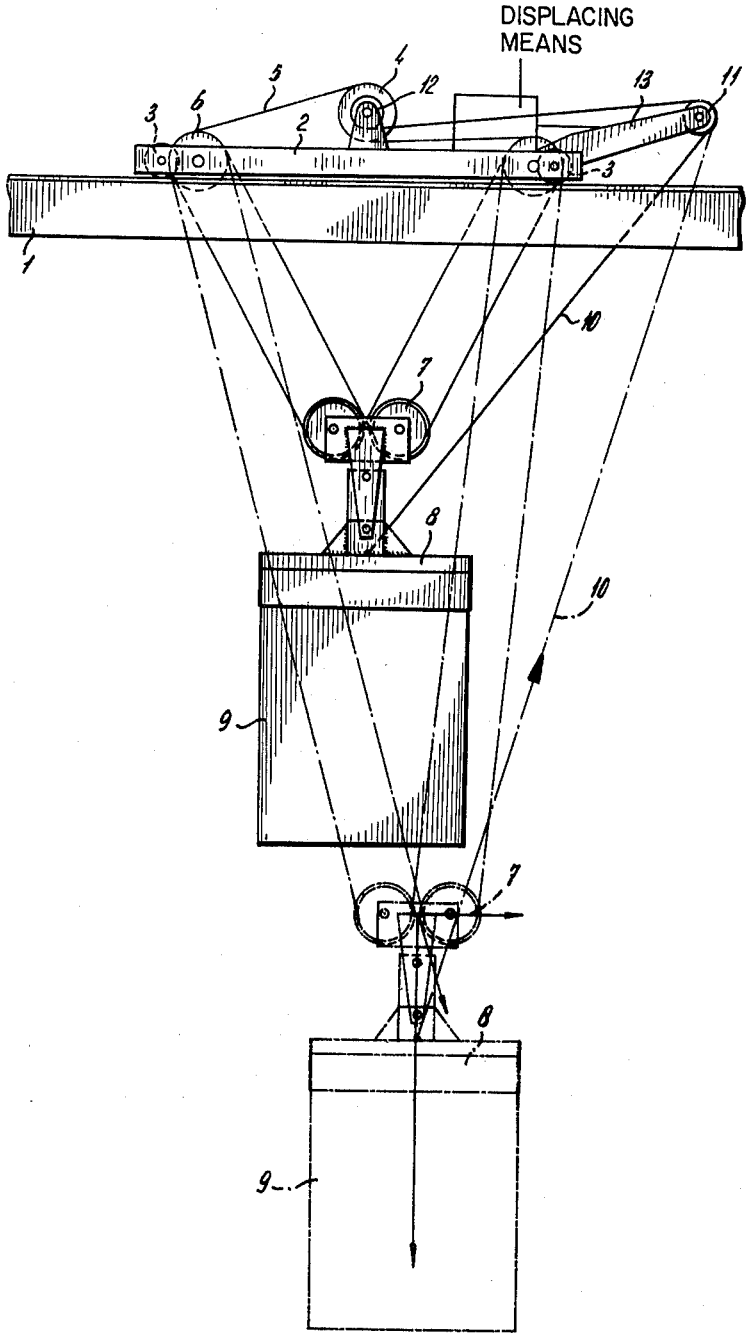
DISPLACING
MEANS
1
2
3
3
4
5
6
7
7
8
8
9
9
10
10
11
12
13

DEVICE FOR THE PURPOSE OF PREVENTING A BODY DEPENDING FROM ROPES FROM SWINGING

FIELD OF THE INVENTION

The invention relates to a device for the purpose of preventing a body depending from one or more ropes, if necessary through an intermediate engaging means, from swinging, particularly in a container bridge having a trolley, comprising special so-called positioning wires, i.e. wires extending at an angle to the vertical and wound around a drum and connected at the opposite end to the body or the engaging means.

PRIOR ART

A device of this type is known from the Dutch patent application No. 71,01224.

In this known device the positioning wires are arranged in pairs, i.e. that with respect to both sides of one or each pair confronting sides of the body or the engaging means one or more positioning wires extend obliquely upwardly in opposite direction.

This known device has the disadvantage that in applying in a container bridge having a trolley, this trolley must be of relatively great length, so that the body depending from the hoisting ropes substantially below the center of the trolley can be positioned only to a predetermined distance from points situated perpendicularly underneath both ends of the bridge, resulting in a limited positioning range.

SUMMARY OF THE INVENTION

An object of the invention is to provide a device of the aforementioned type in which this disadvantage is obviated.

According to the invention this object is achieved in that in the device according to the invention one or more positioning wires extend obliquely in the same direction upwardly exclusively from one of one or each pair confronting sides of the body or the engaging means, and the drum of each wire is of such shape and/or can be driven so, that in lowering, the positioning wires are paid out to a less extent than the hoisting ropes.

The drum of each positioning wire may be coupled directly to the drums of the hoisting ropes, the first mentioned drum having at least a portion with a diameter smaller than that of the last mentioned drums. The drum of each positioning wire may, for instance, be a conical drum whose smallest diameter is smaller than the diameter of the hoisting drums.

In this way, the trolley can be of a short length while nevertheless the load depending from the ropes is not permitted to swing. By the fact that in paying out the hoisting ropes the positioning wires are paid out to a less extent, the body depending from the hoisting ropes is lowered not along a vertical path but is pulled to one side by the positioning wires, so that the body is subjected to a force which tends to return the body to the vertical, which return force has to be overcome in swinging of the body to one side in the direction in which the positioning wires extend obliquely upwardly, while in the opposite direction the positioning wires retain directly the swinging movements of the body.

The return force can be calculated exactly, while by passing the positioning wires over sheaves mounted for a displacement to the respective drums, the return force can be controlled by displacing the sheaves outwardly or inwardly with respect to the trolley. In this way also the final positioning of the body can be defined exactly, while the body can also be rotated slightly in a horizontal plane by displacing one sheave to the front or to the back with respect to the other sheave.

BRIEF DESCRIPTION OF THE DRAWING

The invention will now be described in more detail by referring to the drawing in the sole FIGURE of which an embodiment according to the invention is shown by way of example.

DETAILED DESCRIPTION

In the drawing is shown a part of the girder 1 of a container bridge, over which the trolley 2 can be displaced by means of the wheels 3. On the trolley is mounted a hoisting drum 4, from which hoisting ropes 5 extend over sheaves 6 to sheaves 7 of an engaging means in the form of a spreader 8, from which spreader a container 9 depends. On the spreader 8 is fixed at least one positioning wire 10 which is passed over the sheave 11 to the drum 12. The drum 12 is coupled to the hoisting drum 4 and has a diameter which is smaller than that of the hoisting drum 4, so that in lowering, the positioning wire 10 is paid out to a less extent than the hoisting rope 5. In lowering the container 9, this container is pulled to the right in the drawing, so that the container 9 is lowered not along the vertical, as is shown clearly in the drawing, in which the position of the container 9 at a lower elevation is shown in dotted lines. Consequently, a return force will act on the container which tends to return the container to the vertical, which force has to be overcome in swinging of the container 9 further to the right in the drawing. The container 9 will be prevented from undergoing a swinging movement to the left in the drawing directly by the positioning wires 10.

A diverting sheave 11 for the positioning wire 10 may be mounted for displacement relative to the trolley 2, e.g. by mounting the arm 13 for a shifting movement on the trolley, means being provided for displacing the arm 13. By this arrangement the return force can be controlled.

I claim:

1. A device for raising and lowering a load while preventing swinging of the load, said device comprising a container bridge, a trolley displaceable on said bridge, a drum on said trolley, sheaves on said drum and on the load to be raised and lowered, hoisting cables extending from said sheaves on said drum to the sheaves on the load for lowering and raising the load by pay-out and wind-up of the cables, and means for preventing swinging of the load comprising at least one positioning wire connected to said trolley for being paid-out and wound-up, one end of said positioning wire being secured to said load such that said wire extends obliquely upwards therefrom at an angle with respect to said hoisting cables, and a further drum on said trolley, the other end of said positioning wire being attached to the further drum on the trolley to pay-out and wind-up the positioning wire to a smaller extent than the hoisting cables such that the load is raised and lowered along a path inclined with respect to the vertical.

2. A device as claimed in claim 1 wherein the drum for the hoisting cables and the drum for the positioning wire are coupled together in rotation, the diameter of the drum for the positioning wire being smaller than the diameter of the drum for the hoisting cables.

3. A device as claimed in claim 2 wherein said drums are coaxially arranged.

4. A device as claimed in claim 2 comprising an arm on said trolley, and a further sheave on said arm, said positioning wire extending from said drum for the positioning wire over said further sheave to said load.

5. A device as claimed in claim 2 comprising a plurality of said positioning wires arranged in a common plane.

6. A device as claimed in claim 4 further comprising means for displacing said further sheave with respect to said trolley.

* * * * *